US006484328B1

(12) United States Patent
Frazier

(10) Patent No.: US 6,484,328 B1
(45) Date of Patent: Nov. 26, 2002

(54) HYGIENIC ARTICLE AND METHOD OF USE

(76) Inventor: Jeffery D. Frazier, 1755 Alameda, Redwood City, CA (US) 94061

( * ) Notice: Subject to any disclaimer, the term of this patent is extended or adjusted under 35 U.S.C. 154(b) by 0 days.

(21) Appl. No.: 09/847,131

(22) Filed: May 3, 2001

(51) Int. Cl.[7] ..... A47K 13/24
(52) U.S. Cl. ..... 4/661; 4/245.3
(58) Field of Search ..... 4/245.3, 245.4, 4/661

(56) References Cited

FOREIGN PATENT DOCUMENTS

DE 2835028 * 2/1980 ..... 4/245.3
FR 2560763 * 9/1985 ..... 4/245.3

* cited by examiner

*Primary Examiner*—Charles E. Phillips
(74) *Attorney, Agent, or Firm*—Jeffery D. Frazier

(57) ABSTRACT

The present invention provides a device and method for improved toilet hygiene. One aspect of the present invention provides an improved toilet seat cover having an affinity for a toilet seat. Another aspect of the present invention provides a method for rendering a toilet seat cover in a state wherein the cover possesses an affinity for a toilet seat. Such affinity can be established in a variety of ways, including by way of disparate surface charges (e.g., by triboelectric charging).

16 Claims, 3 Drawing Sheets

HYGIENIC ARTICLE AND METHOD OF USE

FIELD OF THE INVENTION

The present invention relates to hygienic articles, in particular, toilet seat covers.

REFERENCES

"Triboelectric Charging of Common Objects", Thomas B. Jones, University of Rochester, http://www.ee.rochester.edu:8080/~jones/demos/charging.htm1, December, 1999.

"TRIBOELECTRIC SERIES", William Beaty, http://www.eskimo.com/~billb/emotor/tribo.txt, 1995.

BACKGROUND OF THE INVENTION

The problems associated with toilet seat sanitation have long been recognized. Toilet seats contaminated with human waste, bacteria, and/or viruses create various health risks. It has been reported that by touching a toilet seat just one time, it takes at least five consecutive hand washings to get rid of most of the germs and bacteria. Thus, it is not unusual that one might catch a cold or influenza as a result of touching a toilet. Elderly persons, immunocompromised people, chemotherapy patients, pregnant women, young children, and people with diabetes are particularly susceptible to toilet germs and bacteria.

Public places, such as bus stations, airports, restaurants, movie-houses, and office buildings generally provide facilities used by large numbers of people. It is often not practicable, nor is it practiced, to adequately clean the toilet seat between uses. Consequently, such facilities, on the whole, are not clean and not esthetic.

The problem of toilet seat sanitation has been addressed several ways. One approach has been to provide a toilet seat cover that minimizes contact between the toilet seat and a user. Such a cover can take the form of a layer of protective material between the user and the toilet seat. Usually, such covers define an eliptical ring which have an outer dimension like that of the toilet seat and an inner dimension which permits uninterrupted bowel movement and urination.

Known toilet seat covers of the above-mentioned type suffer from the considerable disadvantage that they tend to slide off the toilet seat; e.g., either into the toilet bowl itself, or onto the floor area near the toilet. Obviously, this creates waste of raw materials, as a user must utilize a fresh cover, and potentially contributes to further filth in cases where the cover falls on the floor and is left there.

Clearly, further advancements in the art of toilet hygiene are needed.

SUMMARY OF THE INVENTION

An aspect of the present invention provides a method for improved toilet hygiene. In an embodiment of the invention, the method comprises: (i) treating a toilet seat cover to provide the cover with a non-neutral surface charge; and (ii) overlaying the cover on a toilet seat, such that the cover clings to the seat due to the non-neutral surface charge.

The method further comprises, in one embodiment, treating the toilet seat to provide a surface of the seat with a non-neutral surface charge. In one embodiment, the seat charge is formed by way of induced polarization.

According to an embodiment of the invention, at least 20%, at least 30%, at least 40%, at least 50%, at least 60%, at least 70%, at least 80%, at least 90%, and/or at least 95% of the surface area of one side of the cover is in intimate clinging contact with the seat. Such surface-area percentages are considered herein to comprise a substantial portion of the cover. In some embodiments, about 25%, or about 50%, or about 75% of the surface area of one side of the cover can be caused to cling to the surface of the seat for a period of time (e.g., greater than 20 seconds).

In one embodiment, the treating of the toilet seat cover comprises tribocharging (also known as "triboelectric charging," "contact charging" or "electrification by contact"). In another embodiment, the treating includes passing the cover through an electric field.

Another aspect of the present invention provides a method for improved toilet hygiene, comprising: (i) establishing a charge differential between a toilet seat cover and a toilet seat; and (ii) overlaying the cover on the toilet seat, such that the cover clings to the seat (due to the charge differential).

The establishing step can be selected from the group consisting of triboelectric charging, inducing polarization, and passage through an electric field, among others.

In various embodiments, the charge differential is at least 50V, at least 75V, at least 100V, at least 150V, at least 200V, at least 250V, at least 300V, at least 500V, at least 750V, at least 1,000V, at least 2,500V, at least 5,000V, and/or at least 10,000V, or higher. In an embodiment of the invention, the charge differential is maximized.

In another of its aspects, the present invention provides a device for use with a toilet seat, comprising a laminar (multi-layer) sheet-like material configured to fit upon a toilet seat, and having a first outer layer on one side and a second outer layer on an opposite side. In one embodiment, the first and second layers are comprised of first and second materials, with the first and second materials having unlike triboelectric properties such that when surfaces of the first and second materials are brought into intimate contact with one another and then separated each acquires a non-neutral surface charge.

In its operative condition, the cover can be utilized in a sheet-like configuration, or it can be configured into a sleeve-like arrangement adapted to slidably fit over a toilet seat.

In one embodiment, the toilet seat cover is comprised, at least in part, of an insulating (substantially non-conducting) material.

In one embodiment, a plurality of such sheet-like materials are releasably connected to one another end-to-end, and are wound so as to define a roll configuration.

In another embodiment, a plurality of such sheet-like materials are arranged in a stack, with each sheet-like material of the stack disposed in intimate contact with its nearest neighbors (or neighbor, in the case of the first and last sheets). Further in this embodiment, the first layer of each sheet-like material of the stack is disposed facing in a first direction and the second layer of each sheet-like material of the stack is disposed facing in a second direction, wherein the second direction is opposite of the first direction.

One of the layers can be comprised, for example, of a paper material (e.g., tissue). The other of the layers can optionally be provided with adhesive properties (e.g., a slight degree of stickiness or tackiness).

In one embodiment, one of the layers comprises an electret.

A further aspect of the present invention provides a dispensing device for dispensing toilet seat covers. In an embodiment of the invention, the dispensing device comprises: a compartment adapted to hold a plurality of toilet seat covers; an orifice defined by a wall of the compartment permitting one of the covers to be pulled therethrough for removal from the compartment; and a charge-imparting member positioned such that a cover pulled through the orifice must pass closely by (e.g., rub against) the charge-imparting member. In use, a cover removed from the dispenser via the orifice gains a non-neutral surface charge.

In one embodiment, the charge-imparting member and the covers have unlike triboelectric properties. For example, the covers can be a paper material and the charge-imparting member can comprise a vinyl surface.

In another embodiment, the charge-imparting member is an electrostatic generator.

These and other features and advantages of the present invention will become better understood with reference to the following description, drawings, and appended claims.

BRIEF DESCRIPTION OF THE DRAWINGS

The structure and manner of operation of the invention, together with the further objects and advantages thereof, may best be understood by reference to the following description taken in conjunction with the accompanying drawings, in which identical reference numerals identify similar elements, and in which.

DETAILED DESCRIPTION OF THE INVENTION

Figure 1:
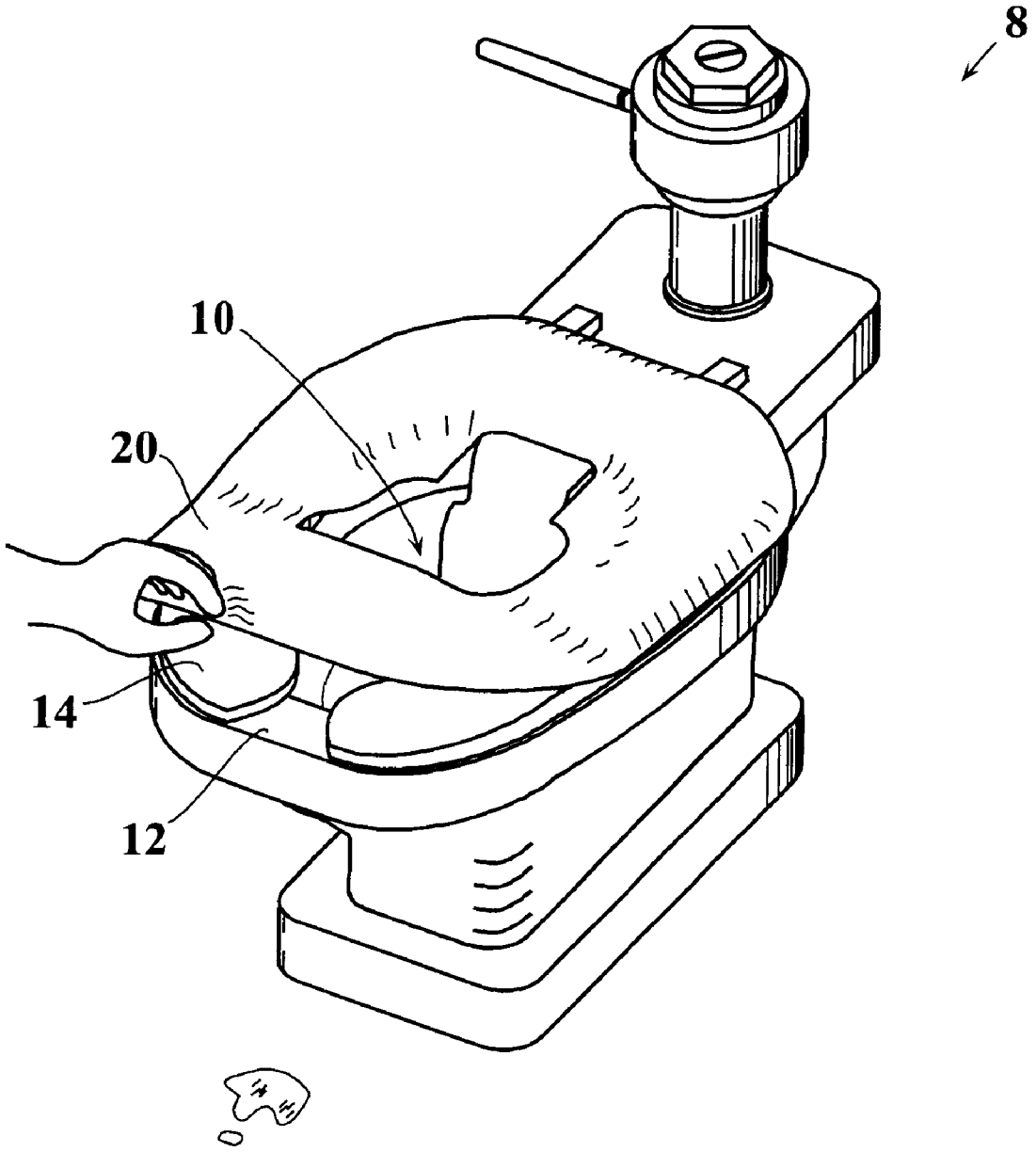
FIG. 1 is a perspective view of a toilet, suitable for practicing the present invention, and illustrating placement of a toilet seat cover upon the toilet seat, according to the present invention.

The following discussion of the preferred embodiments of the present invention is merely exemplary in nature. Accordingly, this discussion is in no way intended to limit the scope of the invention, application of the invention, or the uses of the invention.

The present invention provides a device and method for improved toilet hygiene. Certain aspects of the present invention provide toilet seat covers having an affinity for toilet seats. Other aspects of the present invention provide methods for rendering toilet seat covers in a state wherein the covers possess an affinity for toilet seats. Related aspects of the present invention provide toilet seats having an affinity for toilet seat covers. Further related aspects of the present invention provide methods for rendering toilet seats in a state wherein the seats possess an affinity for toilet seat covers.

Various embodiments of the present invention provide for the treatment of a toilet seat cover such that the cover acquires a non-neutral surface charge. In addition, or in the alternative, a toilet seat upon which the cover is to be placed can be treated to have a non-neutral surface charge. The charging is such that the two objects experience an attractive force.

Force acts between two objects with charge, attractively between objects with opposite charges, repulsively between objects with similar charges. The magnitude of the force depends on the product of the two charges (in coulombs, C) divided by the square of the distance between the centers of charges.

$$F_6 = kq^1q^2r^2$$

Charles Augustin de Coulomb (1736–1806), French physicist, determined the Coulomb constant, $k=8.988\times 10^9 Nm^2/C^2$.

Induced polarization allows a charged body to attract an initially neutral body.

Various embodiments of the present invention exploit the phenomenon known as "triboelectric charging," or "tribocharging" for short. This phenomenon is also referred to as "contact charging" or "electrification by contact."

Some general principles of tribocharging will now be discussed.

When two materials with neutrally charged surfaces come into contact (within 8 Å, and preferably 4 Å, or less) and then separate, the materials will have undergone triboelectric charging and now be at a non-neutral surface charge level. The level and polarity this newly acquired surface charge is at is dependent on several factors, but can be relatively answered by reference to a triboelectric series chart (i.e., a ranking of a material's polarity when triboelectrically charged with a given material), such as shown in Table 1.

TABLE 1

| TRIBOELECTRIC SERIES | | |
|---|---|---|
| Human Hands | <---- | Most Positive (acquires a more positive charge; Lower work function) |
| Asbestos | | |
| Rabbit Fur | | |
| Acetate | | |
| Glass | | |
| Mica | | |
| Human Hair | | |
| Nylon | | |
| Wool | | |
| Fur | | |
| Lead | | |
| Silk | | |
| Aluminum | | |
| Paper | | |
| Cotton | ------ | ZERO |
| Steel | | |
| Wood | | |
| Amber | | |
| Sealing Wax | | |
| Hard Rubber | | |
| MYLAR | | |
| Nickel, Copper | | |
| Silver | | |
| UV Resist | | |
| Brass, SS | | |
| Gold, Platinum | | |
| Sulfur | | |
| Acetate, Rayon | | |
| Polyester | | |
| Celluloid | | |
| Styrene (Styrofoam) | | |
| Orlon | | |
| Acrylic | | |
| SARAN | | |
| Polyurethane | | |
| Polyethylene | | |

TABLE 1-continued

| TRIBOELECTRIC SERIES | | |
|---|---|---|
| Polypropylene | | |
| Vinyl (PVC) | | |
| KEL F | | |
| Silicon | | |
| Teflon | | |
| Silicone Rubber | <----- | Most Negative (acquires a more negative charge; Higher work function) |

For example, a material such as glass that comes into contact with a vinyl material will acquire a more positive charge because it is near the 'more positive' position in the triboelectric series chart relative to the position of vinyl. Alternately, the vinyl will acquire a more negative charge following the same logic. The fact that these two materials are far apart from each other in the series may result in a larger charge level generated than if the glass came into contact with, for example, aluminum.

It should be appreciated that the terms "triboelectric charging" (or "tribocharging"), "contact charging" and "electrification by contact" are particularly apt, as they avoid giving the idea that the mechanism for the electrification is caused by friction. In this regard, it is noted that the term "frictional electrification" is misleading. Separation of charges is not accomplished by friction per se. When surfaces come together chemical bonds can form. When surfaces in contact are separated, the bonds can rupture, and any asymmetrical bonds (such as ionic bonds) will tend to leave imbalanced charges behind.

There are several mechanisms that contribute to the resulting charge that is generated by the triboelectric process. There appear to be four major factors that have the greatest influence on the triboelectric charging process, and they are: surface contact effects; work function; charge back flow; and gas breakdown.

Surface contact effects include the surfaces roughness, contact force, and frictional heating (caused by rubbing), all of which influence the amount of surface area that is in contact with the other material during tribocharging. The greater the surface contact, the greater the resulting net charge may be when two surfaces are separated after contact.

Though surface contact may seem rather intuitive, there are some subtleties that should be elaborated on; one being surface friction, the other surface roughness. When the coefficient of friction between two surfaces increases, this indicates that the surface roughness between the two surfaces may be greater, which results in decreased surface contact. As an illustration, when two surfaces are brought together, e.g., over about 1.0 square inch, the actual or physical contact may only be about 0.2 square inches because of surface roughness. Upon pressing the surfaces together, the contact area may increase to about 0.4 square inches, depending on the force of pressing and, again, the surface roughness of both surfaces. If both surfaces were polished to an extremely smooth and flat area (micro-polished), the contact area may be further increased to about 0.8 square inches. The smoother either surface is, the more contact both surfaces will make with each other resulting in possible increase of the exchange of charges.

Surface charge imbalance is related to friction in that both are dependent on the adhesion between two surfaces on the molecular level. Two surfaces may stick together because chemical bonds form on the surface. When surfaces in contact are separated, some bonds may rupture, and any asymmetrical bonds will tend to leave imbalanced charges behind. Which surface bonds rupture is dependent on their work function. The work function is the property of a material's ability to hold onto its free electrons (the electrons orbiting the outer most shell of the material). The greater the material's work function, the less likely it is to give up its free electrons during contact (triboelectric generation). The weaker the work function is, the more likely the material will acquire a more positive charge by giving up or loosing some of its free electrons. In general, materials with higher work functions tend to appropriate electrons from materials with lower work functions.

Charge backflow occurs when two materials have been charged, e.g., from the above mechanisms, and are then separated from intimate contact. The backflow of some of this charge imbalance may flow back to the original material reducing to some degree the net charge (charge imbalance) on either surface from tribocharging.

Gas breakdown can occur between two surfaces during separation. The microscopic surface topology of a surface has many peaks and valleys. It is one of these peaks that may have substantial charge that yields a large electric field in a very small area causing corona discharge or the breaking down of the air molecules which were acting as a dielectric (insulator between the two separating surfaces). During this breakdown, charge can be transferred from one surface to the other via the path of the electrified air (plasma). The amount of charge transferred is dependent on the distance of separation and the gas(ses) pressure(s).

In embodiments of the present invention, conditions leading to charge backflow and/or gas breakdown are to be minimized or avoided.

Standard cellulose tape is a good example of a material that has a strong surface adhesion and consequential large surface area contact typically resulting in large charge imbalance during unwind or removal. During unwind, the contact and separation of the tape to itself results in triboelectric charging. An important contribution to the large imbalance of the tape during unwind is the difference in materials comprising the tape. Typical tape films are cellulose, and the adhesives are often rubber based. The two are spaced far enough apart in the Triboelectric Series to result in defined polarities, see Table 1. The rubber adhesive will acquire a more positive charge and the cellulose will acquire a more negative charge due to the difference in their work functions. Voltages well over 20 kV are easily measured from this type of tape.

In accordance with various embodiments of the present invention, a toilet seat cover ("cover") is tribocharged before it is finally placed on a toilet seat ("seat") and sat upon. The charge established on the cover provides a "cling" characteristic that assists in maintaining the cover in place once situated on the seat.

The present invention can be practiced in connection with a wide variety of toilet seats, provided that the material comprising the toilet seat top is such that a charge separation can be maintained, at least until such time that a user becomes situated on the cover and, preferably, throughout at least most of the period of use. In various embodiments of the invention, the affinity between the toilet seat cover and toilet seat is sufficient to maintain the cover in intimate clinging contact with the seat for at least 10 seconds, at least 15 seconds, at least 20 seconds, at least 30 seconds, at least 45 seconds, and/or at least one minute.

Toilets are typically formed with a bowl having an upper elliptic rim defining a generally horizontal plane. A seat is usually associated with the toilet and is supportable on the rim, permitting a user to sit above the bowl. For example, FIG. 1 shows a toilet 8 having a bowl 10, an upper rim 12, and an essentially annular toilet seat 14. Seat 14 is configured for pivotal movement at its rearward end to allow tilting up and down. It should be noted that the words "essentially annular" are intended to include any seat shape, such as oval, ring-like, elongated, horse-shoe shape, or the like, and encompasses both open-front and closed-front seats. In FIG. 1, seat 14 is an open-front seat.

In certain embodiments, covers of the present invention generally have an inner and outer radius substantially like that of a seat with which they are likely to be used. The cover can be incorporated into a square or rectangular sheet, and adapted to be separated from nonessential pieces or regions of the sheet just prior to use. For example, perforations or scoring can allow the cover to be readily torn from the sheet. It should thus be appreciated that a great variety of shapes are contemplated herein for a cover of the invention. For example, a cover of the invention can mimic the design of a large elongated oval toilet seat, a relatively small slightly elongated oval toilet such as is frequently found in outhouses, or essentially any other shape of toilet seat.

In one embodiment, a toilet seat cover is treated to provide the cover with a non-neutral surface charge. As shown in FIG. 1, the cover 20 can then be laid upon a toilet seat 14, such that the cover clings to the seat.

In certain embodiments, a toilet seat cover, such as 20, according to the present invention, is macroscopically two-dimensional and planar, although not necessarily flat. The toilet seat cover 20 may have some thickness in the third dimension. However, the third dimension is very small compared to the first two dimensions.

According to certain embodiments, toilet seat covers according to the present invention are configured to exhibit good drapability. Drapability is the tendency of the toilet seat cover to conform, normal to its plane, to a surface, such as a toilet seat upon which the toilet seat cover is placed. The higher the drapability of the toilet seat cover, the more accurately it will conform to the surface. More accurate conformation to the surface can provide greater retention thereon.

The covers of the present invention can be especially advantageous when used with contoured seats; a situation where prior art toilet-seat covers often fail. Having a sufficient surface charge, the cover will cling to the contours of the seat.

In various embodiments of the present invention, a toilet seat cover is comprised of a material ranking higher in the triboelectric series (i.e., closer to the "most positive" end) than the material comprising a toilet seat in connection with which it is to be used. For example, a toilet seat cover of the present invention comprised of a paper material, e.g., a soft tissue-type paper, can be well suited for use with a toilet seat comprised of polyethylene, polypropylene, Lucite acrylic, ABS plastic, or the like. Of course, this example is not limiting, as many combinations of materials can be selected, using the principles provided herein as a guide, permitting one to realize the benefits of the present invention.

With regard to the selection of cover and seat materials, various embodiments of the present invention provide that one should choose two materials that are relatively far apart on the triboelectric series (e.g., separated by at least 3, 5, 7, 10, or more entries [with reference, for example, to Table 1]). In one embodiment, the surfaces of the toilet seat cover and toilet seat that will be adjacent one another upon placing the cover on the seat are comprised of different materials, with one of the materials being located towards the "more positive" side of the "zero" line in the triboelectric series, and the other material being located towards the "more negative" side of the "zero" line in the triboelectric series (See Table 1).

One embodiment provides that the only limitation on the material comprising the toilet seat is that it not significantly disrupt a surface charge of the cover. For example, the toilet seat should not be a good electrical conductor.

It should be noted that the order of materials in the triboelectric series is not strict or invariable. A material might shift up or down an entry or two depending upon the conditions of the particular materials involved and their local environment. Moreover, the present invention is not limited to those materials set out in Table 1. Rather, the present invention contemplates a methodology of determining materials suitable for use herein by testing selected materials with one another for tribocharging efficiency and efficacy. The materials of Table 1 can be used as a guide, or yardstick, in selecting types of materials and predicting where such materials might rank in the series. However, an ultimate decision on the suitability of any particular material (s) is best made by simply testing the materials with one another.

A charge differential between the cover and the toilet seat can be established in a variety of ways. For example, the cover can be placed in contact with the seat, then removed, thereby tribocharging the cover. Such charging will be most effective where the topside of the toilet seat is generally flat (planar) so that good surface contact can be made between the toilet seat and the cover prior to separation.

In one embodiment, it is preferable that the materials comprising the cover and seat be capable of attaining intimate contact over a relatively large area. Thus, materials having a rough surface that hinder surface contact should be avoided. Good surface contact between the two materials helps to encourage strong charging when the materials are touched surface-to-surface and then pulled apart.

Figure 2:
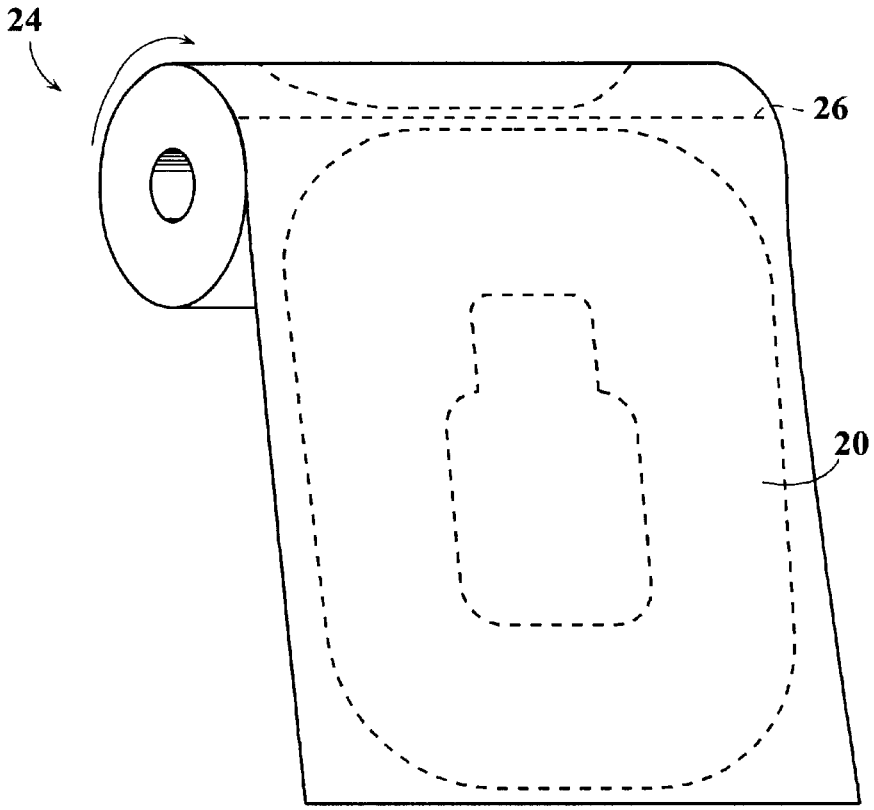
FIG. 2 is a perspective view that illustrates tribocharging during unwinding of a toilet seat cover from a roll, according to the present invention.

FIG. 2 illustrates tribocharging during unwinding of a toilet seat cover from a roll, according to an embodiment of the present invention. The toilet seat cover 20, in this embodiment, is provided as a roll, in the nature of a roll of paper towels or toilet paper, such that a user partially unwinds the roll, e.g., in the direction of the arrow, to obtain the next-available cover which is then torn from the roll; e.g., aided by a perforation line or scoring, as at 26. In one embodiment, to assist in tribocharging, the cover is a laminate article comprising upper and lower sides of different materials with a spaced-apart ranking in the triboelectric series. For example, one side of each cover on the roll can be a paper-based tissue-type material, and the other side can be a rubber-based film layer, so that tribocharging occurs upon unrolling in a fashion analogous to the tape-dispenser example above. In one such embodiment, the rubber-based film layer has a slight degree of stickiness or adhesiveness, to enhance surface charging, and avoid out-of-control unrolling, upon unwinding to remove a cover from the roll. Of course, the adhesiveness is preferably not so great as to prevent removal of a cover from the roll, or to cause tearing. A dispenser in the nature of an elongated rod can be utilized to receive the roll of FIG. 2 thereover, in a manner permitting unwinding of the roll thereabout.

Similarly, a roll of toilet seat covers of the present invention can be configured to work with automatic or motorized seat covering devices. For example, a roll of covers can be provided on a supply roll, with the covers adapted to pass over the toilet seat for winding on a take-up roll. The present invention can be configured, for example, for use in devices such as disclosed in U.S. Pat. Nos. 5,913,609; 5,685,024; 5,561,867; 5,937,448; 6,076,198; 6,212,693; and/or 5,253,372; each of which is incorporated herein by reference. The present invention can also be used, for example, in automated devices such as disclosed in PCT patent application Ser. Nos. WO 99/38427, WO 87/07492, and/or WO 88/10086; each of which is incorporated herein by reference.

Figure 3:
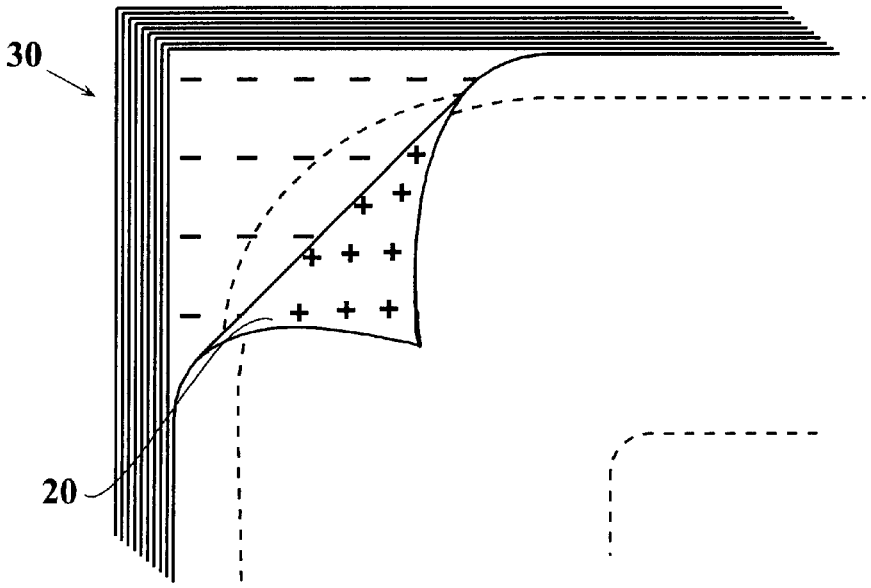
FIG. 3 is a partially schematic, perspective view illustrating triboelectric charging upon peeling a toilet seat cover from a stack, where each cover has front and back surfaces of first and second respective materials having disparate triboelectric properties.

FIG. 3 is a partially schematic illustration of a further embodiment of the present invention. Here, a plurality of toilet seat covers are arranged in a stack, denoted generally as 30. Each cover of the stack is disposed in intimate contact with its nearest neighbors (or neighbor, in the case of the first and last sheets). In one embodiment, a biasing mechanism is provided to keep the covers in pressing engagement. Each cover is comprised of at least two layers. The two layers are comprised of materials differing from one another with respect to their triboelectric properties. A first outermost layer of each cover of the stack is disposed facing in a forward direction and an outermost layer on the opposite side of each cover is disposed facing in a reverse direction. Triboelectric charging is effected upon peeling a toilet seat cover 20 from stack 30. Attention is directed to the plus (+) and minus (–) signs in FIG. 3, indicating positive and negative surface charges upon peeling.

Conveniently, the covers of the present invention can be provided for use with a dispenser; e.g., a dispenser of the wall surface-mounted variety. In one embodiment of the present invention, a dispenser is a bottom-fill unit, having dimensions 15¾"w.×11'h.×2" deep. Such a dispenser is typically configured to hold, for example, 250 or 500 seat covers.

In one embodiment, a vinyl or Styrofoam member is mounted at an orifice of a dispenser through which fresh toilet seat covers are pulled. For example, a vinyl member can include a surface portion disposed such that a seat cover pulled through the orifice is forced to contact it, thereby providing a means for contact electrification. The vinyl member can be bonded to the dispenser by means of a suitable insulating adhesive that will not adversely affect its electrostatic properties. In another embodiment, an electrostatic generator is mounted on the dispenser such that it imparts a persistent electrostatic charge to a cover as the cover is removed from the dispenser.

Figure 4:
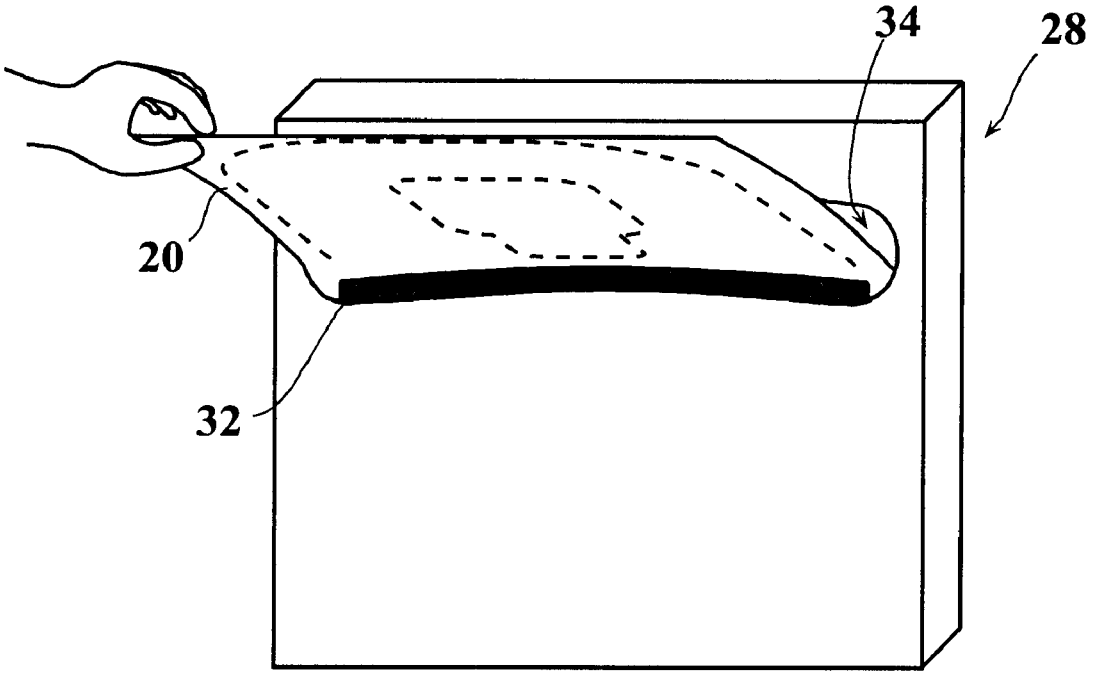
FIG. 4 is a perspective view of a dispenser for toilet seat covers, having a charge-imparting member mounted near an orifice through which individual seat covers can be pulled, according to the present invention.

FIG. 4, for example, illustrates a dispenser 28 for toilet seat covers, having a charge-imparting member 32 mounted near an orifice 34 through which individual seat covers, such as 20, can be pulled.

The above embodiments are to be distinguished from so-called "static-cling films," which have gained popularity in recent years in the nature of self-sticking posters, placards, etc. for windows, mirrors, and the like. Static-cling films are popular substrates because they adhere to smooth surfaces without adhesives. But because of the "static-cling" moniker, it's easy to assume that static electricity is what makes these substrates do what they do best: apply and remove very easily, with no adhesive residue. The truth is, conventional static-cling films have little or nothing to do with static electricity. A heavy plasticizer load provides the physical and chemical properties that enable them to stick to smooth, non-porous surfaces, such as glass, polished metals, and some plastics. On porous or irregular surfaces, however, static-cling films adhere poorly, or not at all.

For a variety of reasons, in certain embodiments of the invention, fibrous covers (e.g., wood pulp, cellulosic or paper-based materials, such as tissue-type paper) are generally preferred herein. For example, such materials are most compatible with existing sewage and treatment facilities. Paper-based products are typically better in terms of biodegradability. In one embodiment, a coating, e.g., a wax (preferably, a water receptive wax) is applied to form one or more layers on a paper sheet.

Nevertheless, the present invention contemplates that so-called "cling films" can be used as a toilet seat cover material. Nonlimiting examples of films include polyvinyl chloride films (whether plasticized or flexible), polyurethane films, high density polyethylene films, polypropylene films, tackified linear low density polyethylene films, acrylonitrile/butadiene/isoprene films, acrylonitrile/butadiene copolymers, styrene/butadiene copolymers (whether random or block), styrene/isoprene copolymers (whether random or block), styrene/ethylene-butylene block copolymers, and combinations thereof, as well as other films known in the art for making cling films.

A "cling" property can be imparted to plastic film by including a high content of plasticizer in the plastic. Polyvinyl chloride films with this property are commercially available from several sources. An example of film having a cling property is Sure-State Series 9000, which is available from Tekra Corporation, New Berlin, Wis.

Permacharge Corp., Rio Rancho, N.Mex., provides an electrostatic polypropylene material called ClingZ. ClingZ gets its adhesive properties from a permanent electrostatic charge. It sticks to almost any clean surface, including brick, chalkboards, drywall, wood, paper, carpet, textiles, and even condensation-heavy windows and beverage coolers. The film is repositionable like other cling films, but ClingZ contains no plasticizers. The present invention contemplates the use of such material, as well, in the make-up of a toilet seat cover herein.

Another embodiment of the present invention contemplates covers comprised of electrostatically charged nonwoven fabrics.

Electrostatically charged nonwoven webs (electrets) useable in the present invention can be made by a number of processes. U.S. Pat. Nos. 4,215,682, and 4,904,174 disclose hot charging methods of charging hot filaments discharging from dies in meltblowing processes for forming meltblown webs. PCT Application PCT/US/93/0930 discloses a cold charging method for electrostatically charging thermoplastic webs. The disclosures of U.S. Pat. Nos. 4,215,682, 4,904,174, and PCT application Ser. No. PCT/US/93/09630 are incorporated herein by reference for disclosing methods, compositions, properties, and specifications of webs capable of being electrostatically charged.

In one embodiment, a nonwoven web or fibers thereof are passed through an electric field, preferably a sequential electric field in accordance with PCT/US/93/09630, to impart a persistent electrostatic charge thereto.

One preferred web is meltblown, but other nonwovens such as spunbonded fabrics can be used.

The web, prior to or after charging, can be processed through the nip of counter-rotating rollers to compress the web and condition the surfaces.

The present invention is suitable for charging nonwoven webs prepared from nonconductive polymeric material such as those selected from the group consisting of polypropylene (PP), recycled and virgin polyethylene terephthalate (PET), all types of polyethylene (PE), such as linear low density polyethylene (LLDPE), polychlorotrifluroethylene (PCTFE), polycyclohexyldimethylene terephthalate (PCT). In addition, the present invention is suitable for charging composite webs containing both conductive and nonconductive fibers such as meltblown/cotton/meltblown thermally bonded webs or meltblown/cotton hydroentangled or needle-punched webs, or hydroentangled mixtures of carded polyester staple fibers and wood tissue, such as SONTARA webs (DuPont).

Another embodiment of the present invention contemplates the use of an electrostatic generator for imparting a charge to a cover. Any of various devices, including the electrophorus, the Wimshurst machine, and the Van de Graaff generator, that generate high voltages by accumulating large quantities of electric charge can be used.

Charges employed are selected to be sufficient for adherence to a selected toilet seat, such that at least 20%, at least 30%, at least 40%, at least 50%, at least 60%, at least 70%, at least 80%, and/or at least 90% of the cover material is in intimate contact with (i.e., appearing to be pressed against) the surface of the toilet seat. In one embodiment, the magnitude of the charges are as large as possible to achieve maximum cling. The cling should last for a sufficient period of time allowing a user to become fully situated thereupon (e.g., about 10 to 15 seconds, or more).

In one embodiment, a surface charge potential of a cover side that is to cling to a toilet seat is in excess of 50V, in another embodiment in excess of 100V, and in yet a further embodiment in excess of 250V. The potential difference can be, for example, 500V; 1,000V; 2,500V; 7,500V; 10,000V; 15,000V; or greater.

The surface charge potential of a cover of the present invention can be determined by any suitable means known in the art, e.g., by a Monroe Model 244 Isoprobe Electrostatic Voltmeter with a 1017E Probe (0.07 in. opening) connected to a Velmex system which allows webs with dimensions up to 20 in.×38 in. to be scanned. The measurement system can be interfaced with an IBM-compatible PC computer using DT 3801 (I/O system (Data Translation Inc., Marlborough, Mass.). The average value of the surface charge potential can be computed.

Further embodiments of the present invention contemplate treating a toilet seat cover such that it acquires a non-neutral surface charge on a surface over which a toilet seat cover is to be placed. A toilet seat cover can then be placed thereon. In one embodiment, the toilet seat cover is polarized upon being brought into proximity with the toilet seat, such that the two objects are then attracted to one another. In another embodiment, the toilet seat cover is charged prior to being brought into proximity with the charged toilet seat, such that the two objects are attracted to one another and the toilet seat cover will, thus, cling to the seat. The toilet seat can be charged by any suitable means; e.g., the seat can be tribocharged using a material having a different ranking in the triboelectric series; or the seat can be treated with an electric field to establish a surface charge thereon; or the seat can be charged by induction; etc.

Those skilled in the art can now appreciate from the foregoing description that the broad teachings of the present invention can be implemented in a variety of forms. Therefore, while this invention has been described in connection with particular embodiments and examples thereof, the true scope of the invention should not be so limited. Various changes and modification may be made without departing from the scope of the invention, as defined by the appended claims.

What is claimed is:

1. A method for improved toilet hygiene, comprising:

providing a dispenser, a plurality of toilet seat covers held by said dispenser, and a charge-imparting member supported by said dispenser;

treating one of said toilet seat covers with the charge-imparting member to provide the cover with a non-neutral surface charge; and overlaying the treated cover on a toilet seat;

whereby the treated cover clings to the seat due to the non-neutral surface charge.

2. The method of claim 1, wherein said treating step is selected from the group consisting of triboelectric charging, inducing polarization, and passage through an electric field.

3. The method of claim 1, wherein said dispenser comprises a compartment configured to hold said plurality of toilet seat covers, with said cover being disposed in a stack.

4. The method of claim 1, wherein said dispenser comprises an elongated rod configured to hold said plurality of toilet seat covets, with said covers begin disposed in a roll.

5. The method of claim 1, wherein said treating comprises pulling said one of said covers from said dispenser so that said one of said covers contacts, and then becomes separated from, said charge-imparting member.

6. The method of claim 5, wherein during said contact said one of said covers rubs against said charge-imparting member.

7. The method of claim 1, wherein said charge-imparting member comprises a means for contact electrification.

8. The method of claim 1, wherein said plurality of toilet seat covers are comprised of a paper material and said charge-imparting member is comprised of vinyl or Styrofoam.

9. The method of claim 1, wherein said charge-imparting member comprise an electrostatic generator.

10. A method for improved toilet hygiene, comprising:

providing a plurality of toilet seat covers, with a surface region of each of said covers being in contact with a surface region of at least one other of said covers;

separating a selected one of said covers from contact with another of said covers, whereby said one of said covers gains a non-neutral surface charge; and overlaying the selected cover on a toilet seat;

whereby the selected cover clings to the toilet seat due to the non-neutral surface charge.

11. The method of claim 10, wherein each of said plurality of toilet seat covers has front and back surfaces having disparate triboelectric properties.

12. The method of claim 11, wherein one of said front and back surfaces comprises a paper material and the other of paid front and back surfaces is selected from the group consisting of a rubber-based film and a material having adhesive properties.

13. The method of claim 11, wherein one of said front and back surfaces is comprised of a material having adhesive properties.

14. The method of claim 10, wherein said plurality of toilet seat covers are disposed in a roll.

15. The method of claim 10, wherein said plurality of said toilet seat covers are disposed in a stack.

16. The method of claim 15, wherein said stack is provided in a dispenser.

* * * * *